United States Patent [19]

Yamamoto et al.

[11] Patent Number: 4,588,131

[45] Date of Patent: May 13, 1986

[54] NOZZLE FOR SPRAYING AGRICULTURAL CHEMICALS

[75] Inventors: Kenzō Yamamoto; Kenji Bessho, both of Wakayama, Japan

[73] Assignee: Yamaho Kogyo Co., Ltd., Wakayama, Japan

[21] Appl. No.: 585,590

[22] Filed: Mar. 2, 1984

[51] Int. Cl.[4] ..... B05B 7/00

[52] U.S. Cl. ..... 239/428.5; 239/590; 239/596; 239/597; 239/600

[58] Field of Search ..... 239/596–599, 239/428.5, 553.5, 590.5, 553, 590, 582, 600

[56] References Cited

U.S. PATENT DOCUMENTS

| | | | |
|---|---|---|---|
| 2,055,864 | 9/1936 | Harsch | 239/590.5 X |
| 2,776,168 | 1/1957 | Schweda | 239/587 |
| 3,462,085 | 8/1969 | Nugarus | 239/590 X |
| 3,669,419 | 6/1972 | Petersen et al. | 239/596 X |
| 3,702,175 | 11/1972 | Watkins | 239/597 X |
| 3,793,690 | 2/1974 | Wayne | 239/590 X |
| 4,330,086 | 5/1982 | Nysted | 239/428.5 X |

*Primary Examiner*—Andres Kashnikow
*Assistant Examiner*—Daniel R. Edelbrock
*Attorney, Agent, or Firm*—Wenderoth, Lind & Ponack

[57] ABSTRACT

A nozzle for spraying a liquid comprises a body formed with a bore extending therethrough and a core removably mounted on the top of the body. The core is formed with a rib on the top thereof and with a notch at each side of the rib. An orifice plate is mounted on the core and is formed with a rib on the upper side thereof. This rib on the orifice plate is hollow so that it may receive the rib on the core. The rib on the orifice plate is formed with a hole in the center thereof so that the liquid may pass up through the bore in the body, through the notches in the core, into the hollow rib on the orifice plate, and spout out through the hole in the rib on the orifice plate in a fan-like shape.

2 Claims, 7 Drawing Figures

NOZZLE FOR SPRAYING AGRICULTURAL CHEMICALS

BACKGROUND OF THE INVENTION

1. Field of the Invention

The present invention relates to improvements in a nozzle for spraying agricultural chemicals or the like.

2. Description of the Prior Art

If a liquid is subjected to pressure feed to a nozzle provided with only an orifice at its tip, the liquid is converted to fog drops and diffused into the air as shown in FIG. 1. When the feed pressure is lowered to spray a small quantity of the liquid, a jet of the liquid spouting through the orifice turns to a film shaped like the flame of a candle (FIG. 2) and then to fog drops with remarkably uneven particle sizes and unstable diffusion.

SUMMARY OF THE INVENTION

It is an object of the present invention to provide a nozzle which eliminates the above-described disadvantage and which is suited for spraying a small quantity of agricultural chemicals and can effectively convert them to fog drops and diffuse them through the air, even at low feed pressures.

Other and further details of the present invention are hereinafter described with reference to the accompanying drawings.

DETAILED DESCRIPTION OF THE PREFERRED EMBODIMENTS

Figure 1:
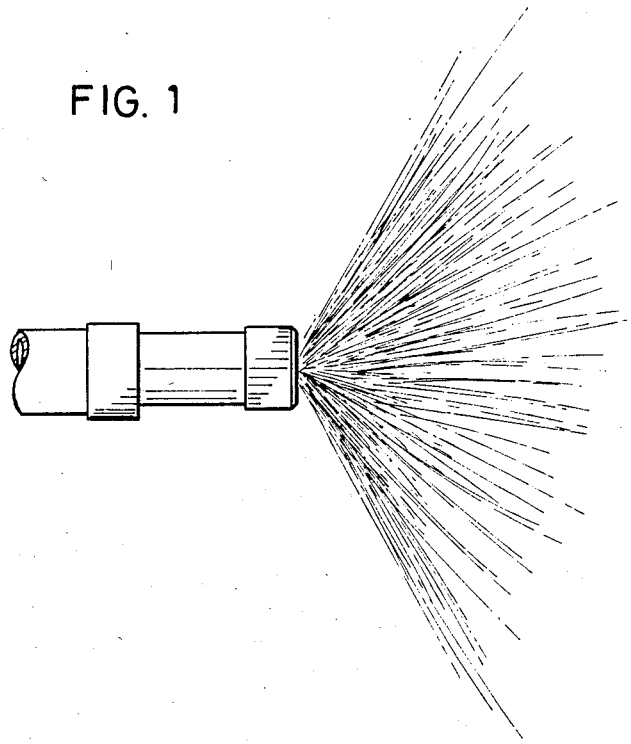
FIG. 1 is a view showing a desired atomizing condition.
Figure 2:
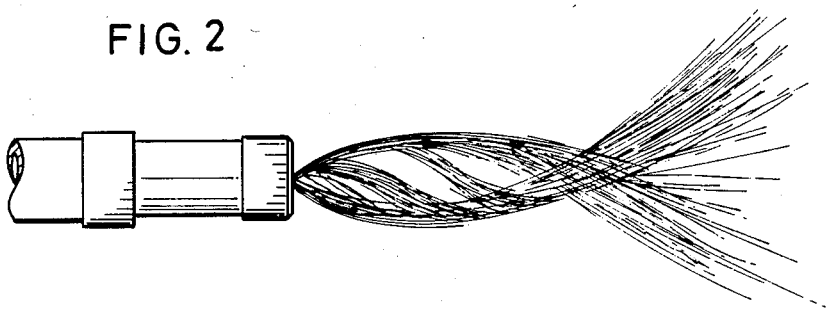
FIG. 2 is a view showing an undesired atomizing condition.
Figure 3:
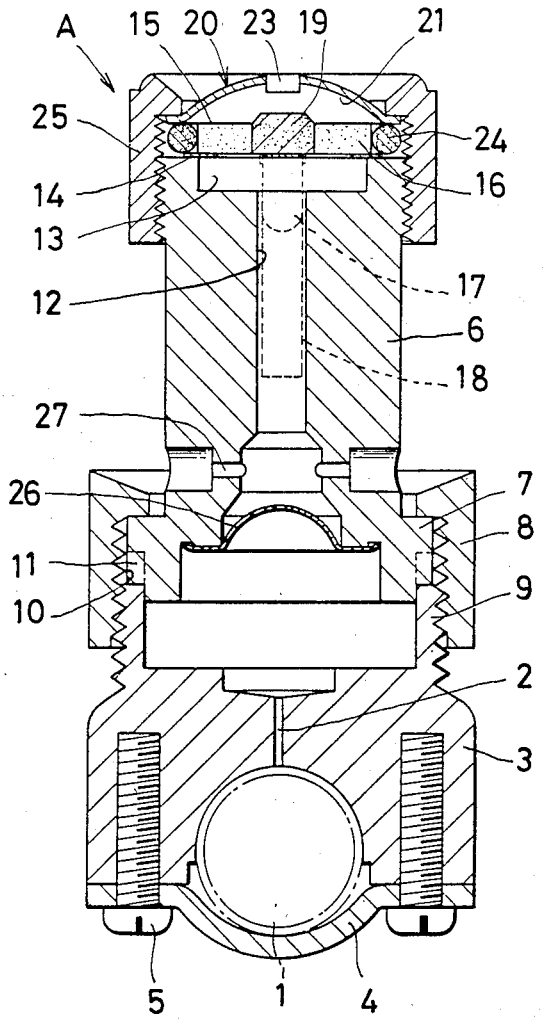
FIG. 3 is a vertical sectional front view of a nozzle in accordance with the present invention.

Referring to FIG. 3 of the drawings, the spray nozzle A in accordance with the present invention has a seat member 3 with a hole 2 communicating with a spray pipe 1. The seat member 3 is mounted on the spray pipe 1 by means of a bracket 4 and bolts 5. The bottom portion of a nozzle body 6 is mounted in the seat member 3. The nozzle body 6 is clamped on the seat member by tightening a nut 8 on a male threaded portion 9 on the seat member 3. The nut 8 engages a flange 7 on the nozzle body 6.

The seat member 3 is formed with two notches 10 in its upper edge (FIG. 4) to receive two projections 11 on the nozzle body 6. This arrangement prevents the nozzle body 6 from turning and positions the nozzle body 6 with respect to the seat member 3.

The nozzle body 6 is formed with a recess 13 which communicates with its bore 12. A core 15 made of plastic is mounted in the recess 13 through a thin protective metal plate 14. The core 15 is provided with two projections 17 on its underside. The projections 17 extend through the metal plate 14 and through holes 18 in the recess 13 of the nozzle body 6. This arrangement prevents the core 15 from turning and positions it with respect to the nozzle body 6.

The core 15 is formed with a rib 19 at each side of which a notch 16 is formed. The rib 19 is adapted to fit in a groove 21 (FIG. 3) formed in the underside of an orifice plate 20. This arrangement prevents the orifice plate 20 from turning and positions it with respect to the core 15.

The orifice plate 20 is formed on its upper side with a rib 22 (FIG. 4) at top of which a jet port 23 is formed. A packing 24 is put around the core 15. By tightening a nut 25, the orifice plate 20 is clamped on the core 15 and on the nozzle body 6.

An orifice plate 26 (FIG. 3) is mounted in the nozzle body 6 to narrow the liquid path leading to the bore 12 in the nozzle body 6. The nozzle body 6 is formed with air holes 27 communicating with the bore 12 at a position adjacent to the orifice plate 26 to mix air into the mist ejected.

In operation, the agricultural chemical is supplied through the spray pipe 1 and is fed through the hole 2, through a hole in the orifice plate 26, through the bore 12 in the nozzle body 6, into the recess 13, and through the notches 16 provided in the periphery of the core 15. The liquid from both sides strikes against each other in the center of the recess 13 and spouts through the jet exhaust port 23 in a fan-like shape.

The gap between the orifice plate 20 and the rib 19 is so small that the liquid violently strikes against each other so as to be effectively atomized even at a low feed pressure. This motion remarkably improves the efficiency in spraying a small quantity of agricultural chemicals.

While the liquid flows into the axial bore 12, air is sucked thereinto through the air suction ports 27 on the principle of an ejector. This air serves to convert the fog drops of the liquid to a foam having coarse particles, which are hard to blow off at long range and is easy to stick to the crops so that a small quantity of agricultural chemicals will be enough.

Figure 4:
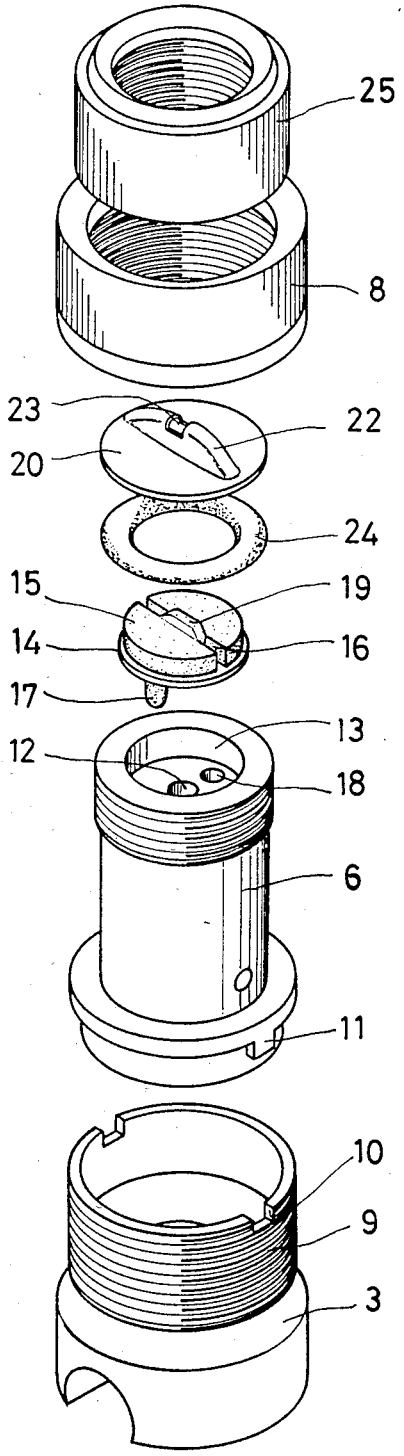
FIG. 4 is an exploded perspective view thereof.
Figure 5:
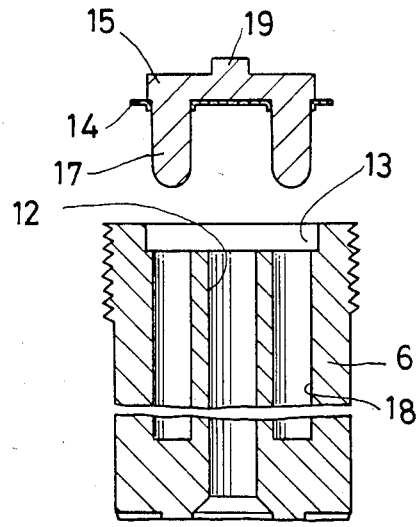
FIG. 5 is an exploded sectional view of a portion thereof.
Figure 6:
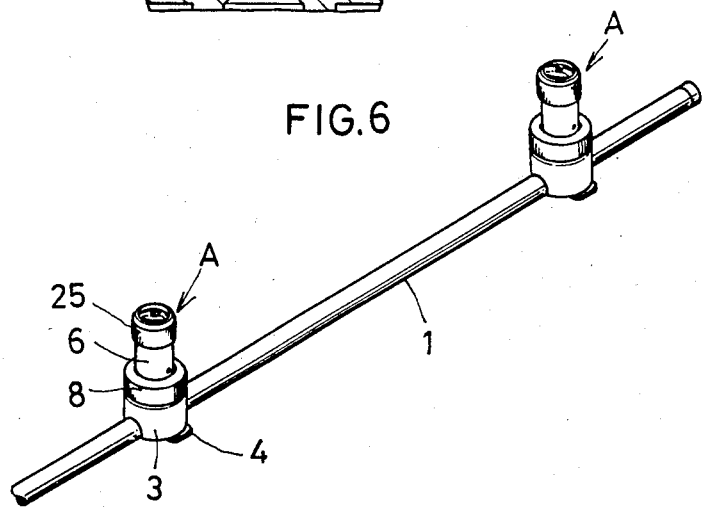
FIG. 6 is a perspective view of the nozzles of this invention mounted on a spray pipe.
Figure 7:
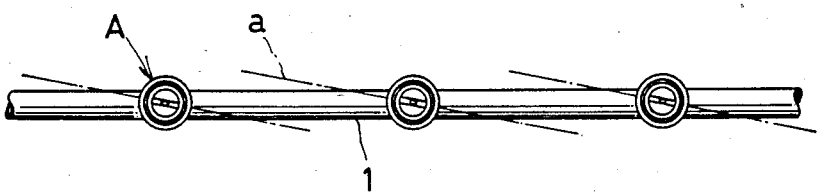
FIG. 7 is a plan view thereof.

As will be understood from the foregoing description of FIG. 4, the orifice plate 20 is positioned contiguous to the core 15 which is positioned contiguous to the nozzle body 6 which is positioned contiguous to the seat member 3 in a stack. Thus, as shown in FIG. 7, the nozzles A are mounted on the spray pipe 1 at an angle a which the rib 22 (FIG. 4) on the orifice plate 20 forms with respect to the spray pipe 1 at the same uniform desired angle. This orientation ensures that the films formed are at the uniform angle to the spray pipe 1 (FIG. 7).

The manner in which these parts are positioned with respect to adjacent parts is not limited to the one embodiment. What is important is that the relative position between the related parts is such that the film of atomized mist forms the same angle for any of the nozzles A with respect to the spray pipe 1 and the films formed do not interfere with one another.

In accordance with the present invention as it is best shown in FIGS. 3 and 4, the liquid is atomized sufficiently, even at a low feed pressure, because of a small gap between the orifice plate 20 and the core 15.

What we claim are:

1. A spray nozzle for spraying a liquid, comprising:

a body formed with a bore extending longitudinally therethrough;

a core mounted on the top of said body and formed with a first rib means on top thereof and with a notch at each side of said first rib means;

hole means, arranged in the body, and first projection means, directed downwardly from the core, for cooperatively preventing the core from turning with respect to the body;

an orifice plate mounted on said core and having a downstream side;

a second rib means, formed on the downstream side of the orifice plate, for cooperating with the first rib means on the core so that the orifice plate is prevented from turning with respect to the core, said second rib means on said orifice plate being hollow to receive therein said first rib means on said core, said second rib means on said orifice plate being formed with a port in the center thereof;

a first nut means for clamping the core and the orifice plate on the body;

a spray pipe;

a seat member mounted on the spray pipe at a desired angle and communicating with the inside of said spray pipe;

a second nut means for clamping the body on the seat member; and notch means, arranged in the seat member, and second projection means, arranged on the body, for cooperatively preventing the body from turning with respect to said seat member;

whereby the liquid passes up through said bore in said body, through said notches in said core, into said hollow second rib means on said orifice plate and spouts out through said port in said second rib means on said orifice plate in a fan-like shape; and further whereby said body, said core, and said orifice plate are positioned with respect to said seat member and said spray pipe at a uniformly desired angle.

2. The spray nozzle as claimed in claim 1, wherein:

said body is further formed with lateral air holes communicating with said bore in said body.

* * * * *